US011607084B2

(12) United States Patent
Williams

(10) Patent No.: US 11,607,084 B2
(45) Date of Patent: Mar. 21, 2023

(54) SHOWER CHAIR

(71) Applicant: Drive DeVilbiss Healthcare, Port Washington, NY (US)

(72) Inventor: Laura Williams, Centerport, NY (US)

(73) Assignee: Drive Devilbiss Healthcare, Port Washington, NY (US)

( * ) Notice: Subject to any disclaimer, the term of this patent is extended or adjusted under 35 U.S.C. 154(b) by 123 days.

(21) Appl. No.: 17/336,054

(22) Filed: Jun. 1, 2021

(65) Prior Publication Data

US 2022/0378253 A1 Dec. 1, 2022

(51) Int. Cl.
*A47K 3/28* (2006.01)
*A47C 11/00* (2006.01)

(52) U.S. Cl.
CPC ..... *A47K 3/282* (2013.01); *A47C 11/005* (2013.01)

(58) Field of Classification Search
CPC ..... A47K 3/282; A47C 11/005
USPC ..... 4/611
See application file for complete search history.

(56) References Cited

U.S. PATENT DOCUMENTS

| | | | | |
|---|---|---|---|---|
| 663,826 | A | 12/1900 | Baker | |
| 5,581,825 | A | 12/1996 | Honsvald | |
| 6,842,919 | B2 | 1/2005 | Wilson et al. | |
| 6,912,740 | B2 * | 7/2005 | Fainberg | A61H 35/00 4/606 |
| 10,813,506 | B1 * | 10/2020 | Mitrano | A47K 3/282 |
| 11,229,567 | B2 * | 1/2022 | Veloz | A61G 7/1003 |
| 2004/0007023 | A1 | 1/2004 | Paci et al. | |
| 2010/0275365 | A1 * | 11/2010 | Fainberg | A61H 35/00 4/578.1 |
| 2019/0350412 | A1 * | 11/2019 | Dickinson | A47K 3/282 |

* cited by examiner

*Primary Examiner* — Huyen D Le
(74) *Attorney, Agent, or Firm* — Moyles IP, LLC

(57) ABSTRACT

A shower chair includes a plurality of legs, a seat board, a showerhead, and a bidet nozzle. The seat board defines an opening therethrough and is configured to be supported on the legs. The seat board includes a control panel with a pair of control knobs. The showerhead is configured to be in fluid communication with a first control knob of the pair of control knobs. The bidet nozzle is coupled to the seat board and configured to be in fluid communication with a second control knob of the pair of control knobs.

26 Claims, 9 Drawing Sheets

SHOWER CHAIR

BACKGROUND

Technical Field

The present disclosure relates to shower chairs, and more particularly, to shower chairs with multiple modes of functionality.

Background of Related Art

For the physically mobile and fully able person, the simple tasks of soaping and rinsing can be trivial. However, persons with physical limitations or impairments, such as those with medical injuries, advanced age, or physical disabilities, may find standing and bathing in a conventional shower structure or reclining and washing in a bathtub difficult or impossible.

Typical shower chairs support a user's body weight in a shower or bath to make showering more safe and easy for those in need. However, there is a continuing need for shower chairs with increased functionality, ease of use, comfort, and safety.

SUMMARY

In accordance with an aspect of the present disclosure, a shower chair is provided and includes a plurality of legs, a seat board, a showerhead, and a bidet nozzle. The seat board defines an opening therethrough and is configured to be supported on the plurality of legs. The seat board includes a control panel with a pair of control knobs. The showerhead is configured to be in fluid communication with a first control knob of the pair of control knobs. The bidet nozzle is coupled to the seat board and configured to be in fluid communication with a second control knob of the pair of control knobs.

In aspects, the control panel may be detachably coupled to the seat board.

In aspects, the seat board may define a first recess therein disposed adjacent a first lateral side of the seat board, and a second recess therein disposed adjacent a second lateral side of the seat board. The shower chair may further include a cover plate configured to be selectively received in either of the first or second recesses. The control panel may be configured to be selectively received in either of the first or second recesses.

In aspects, the shower chair may further include an armrest configured to detachably couple to the seat board.

In aspects, the seat board may have a first lateral side defining a first opening configured for removable receipt of the armrest, and a second lateral side defining a second opening configured for removable receipt of the armrest.

In aspects, the shower chair may further include a backrest configured to detachably couple to the seat board.

In aspects, the armrest may have a coupling for detachably coupling the showerhead to the armrest.

In aspects, the control panel may further include a water inlet configured to fluidly connect to a source of water, a first outlet configured to fluidly connect to the showerhead, and a second outlet configured to fluidly connect to the bidet nozzle.

In aspects, the shower chair may further include a transfer bench assembly configured to detachably couple to the seat board.

In aspects, the transfer bench assembly may include a bench seat and a pair of vertical supports configured to support the bench seat.

In aspects, the bench seat may have a first portion configured to be in horizontal alignment with the seat board, and a second portion extending perpendicularly from the first portion and configured to be disposed outside of a bathtub.

In aspects, the transfer bench assembly may further include a pair of tubular members each having a first end connected to the bench seat, and a second end configured to be connected to a respective one of the plurality of legs.

In aspects, each of the pair of tubular members may have a curved portion configured to be disposed within a bathtub. The second portion of the bench seat and the curved portion may be configured to capture a side of the bathtub therebetween.

In aspects, the shower chair may further include a toilet bucket configured for detachable connection to an underside of the seat board. The toilet bucket may define a cavity in overlapping alignment with the opening of the seat board.

In accordance with another aspect of the present disclosure, a modular shower chair is provided that includes a plurality of legs, a seat board, a bidet nozzle, an armrest, and a transfer bench assembly. The seat board defines an opening therethrough and is configured to be supported on the plurality of legs. The seat board includes opposing first and second lateral sides. The bidet nozzle is coupled to the seat board and is configured to spray water through the opening. The armrest is configured to detachably couple to either of the first or second lateral sides of the seat board. The transfer bench assembly is configured to detachably couple to the seat board.

In aspects, the modular shower chair may further include a control panel with a pair of control knobs. A first control knob of the pair of control knobs may be configured to be in fluid communication with a showerhead, and a second control knob of the pair of control knobs may be configured to be in fluid communication with the bidet nozzle.

In aspects, the transfer bench assembly may include an L-shaped bench seat having a horizontal portion and a vertical portion, a pair of vertical supports configured to support the bench seat, and a pair of tubular members each having a first end connected to the bench seat, and a second end configured to be coupled to the seat board.

As used herein, the terms parallel and perpendicular are understood to include relative configurations that are substantially parallel and substantially perpendicular up to about + or −15 degrees from true parallel and true perpendicular.

As used herein, the term "about" means that the numerical value is approximate and small variations would not significantly affect the practice of the disclosed embodiments. Where a numerical limitation is used, unless indicated otherwise by the context, "about" means the numerical value can vary by ±10% and remain within the scope of the disclosed embodiments.

BRIEF DESCRIPTION OF THE DRAWINGS

Embodiments of the present disclosure are described herein with reference to the accompanying drawings, wherein.

DETAILED DESCRIPTION

Figure 1:
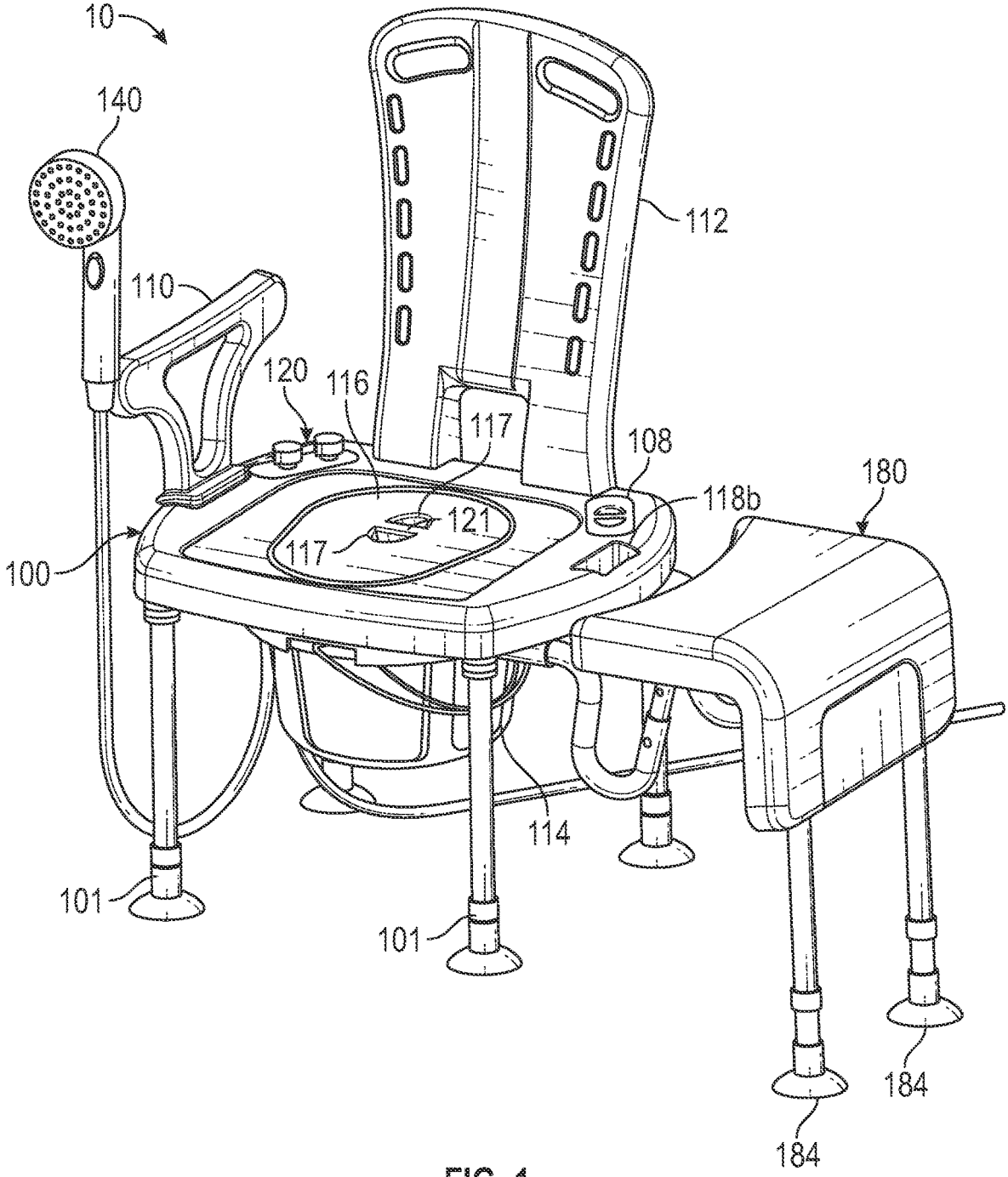
FIG. 1 is a front, perspective view illustrating an exemplary embodiment of a shower chair.

Aspects of the presently disclosed shower chairs are described in detail with reference to the drawings, in which like reference numerals designate identical or corresponding elements in each of the several views.

The present disclosure is directed to a modular shower chair configured to assist a user in cleansing the user's body. The shower chair is easily reconfigurable to suit a user's needs and enables a person to safely sit in a shower or bathtub while also providing easy and convenient showering and bathing tools. The shower chair includes a handheld showerhead connected to a hose and a bottom sprayer (e.g., a bidet nozzle). A user can use the handheld showerhead to direct water where desired and use the bottom sprayer to wash the user's bottom and/or genital area. The shower chair includes a control panel with knobs to control the flow of water to the showerhead and the bottom sprayer. The control panel and an armrest may be moved between left and right sides of the shower chair depending on the user's handedness. The shower chair may include a transfer bench assembly positioned outside a shower or bathtub. The transfer bench assembly enables a user to sit on the transfer bench assembly to easily maneuver onto the seat of the shower chair. For example, where a user may have trouble moving their legs over the walls of a bathtub while standing, they may instead sit on the transfer bench assembly and move one or more legs into the shower or bathtub without having to balance while standing.

With reference to FIGS. 1-5, an exemplary modular shower chair in accordance with aspects of this disclosure is illustrated and is generally designated 10. The modular shower chair 10 generally includes a seat board 100, a plurality of legs 101 coupled to the seat board 100, a control panel 120, a showerhead 140, and a bidet assembly 160 (FIG. 5) (e.g., a bottom sprayer). The shower chair 10 may further include a toilet bucket 114, an armrest 110, a backrest 112, and a transfer bench assembly 180 removably coupled to the seat board 100.

The legs 101 of the shower chair 10 are coupled to an underside 103 (FIG. 5) of the seat board 100 to support the seat board 100 at a selected height relative to the ground. Each of the legs 101 may be telescopic to enable the shower chair 10 to be used for people of different heights or in varying sized bathing stalls (e.g., a shower or bathtub).

The seat board 100 includes a first lateral side 106*a* and an opposite second lateral side 106*b*. Each of the first and second lateral sides 106*a*, 106*b* defines an aperture 118*a*, 118*b* configured for detachable receipt of the armrest 110 via a snap-fit engagement. The seat board 100 defines an opening 102 in a central portion thereof to allow for communication with the toilet bucket 114 to enable a person to use the shower chair 10 as a toilet. The toilet bucket 114 is configured to be removably coupled to the underside 103 of the seat board 100. When the toilet bucket 114 is not in use, the opening 102 may be covered with a toilet lid 116.

The toilet lid 116 is configured to be received in the opening 102 and flush with a top surface of the seat board 100. The toilet lid 116 may define a plurality of drain holes 117 to allow fluid to drain therethrough. The lid 116 may have a handle portion 121 disposed between the drain holes 117 to allow a user to insert their fingers into the holes 117 and grasp the handle portion 121 to remove the toilet lid 116 from the opening 102 in the seat board 100.

The seat board 100 further defines a first recess 104*a* disposed adjacent the first lateral side 106*a* of the seat board 100 and a second recess 104*b* disposed adjacent the second lateral side 106*b* of the seat board 100. The first and second recesses 104*a*, 104*b* are configured to selectively receive the control panel 120 depending on the handedness of the user or the side of the shower chair 100 that an aid is positioned. The shower chair 100 includes a cover plate 108 configured to be inserted in the recess 104*a* or 104*b* unoccupied by the control panel 120.

The first or second recesses 104*a*, 104*b* in the seat board 100 enable the shower chair 10 to be used in a first configuration or a second configuration by selectively receiving either the control panel 120 or the cover plate 108. In the first configuration, the armrest 110 is coupled to the first lateral side 106*a*, the control panel 120 is received by the first recess 104*a*, and the cover plate 108 is received by the second recess 104*b*. In the second configuration, the armrest 110 is coupled to the second lateral side 106*b*, the control panel 120 is received by the second recess 104*b*, and the cover plate 108 is received by the first recess 104*a*. In aspects, the control panel 120 and the armrest 110 may be positioned on opposite lateral sides as one another. For example, the control panel 120 may be received by the first recess 104*a* and the armrest 110 may be received by the second aperture 118*b* on the second lateral side 106*b*. In aspects, a second armrest may be coupled to the other of the first or second lateral sides 106*a*, 106*b*, depending on the configuration of the armrest 110.

The seat board 100 is configured to removably receive the backrest 112. In aspects, the seat board 100 may define backrest openings 119 configured to receive prongs extending from the backrest 112.

In aspects, a seat cushion (not shown) may be configured to be removably coupled to the seat board 100. The seat cushion may include a waterproof shell or fabric. The waterproof shell or fabric may be made from a plastic material. In aspects, the seat cushion includes a foam core.

The showerhead 140 may be configured to removably couple to the armrest 110 via a coupling 142 of the armrest 110. The showerhead 140 is in fluid communication with the control panel 120 via a hose 144, as will be described in further detail below.

Figure 2:
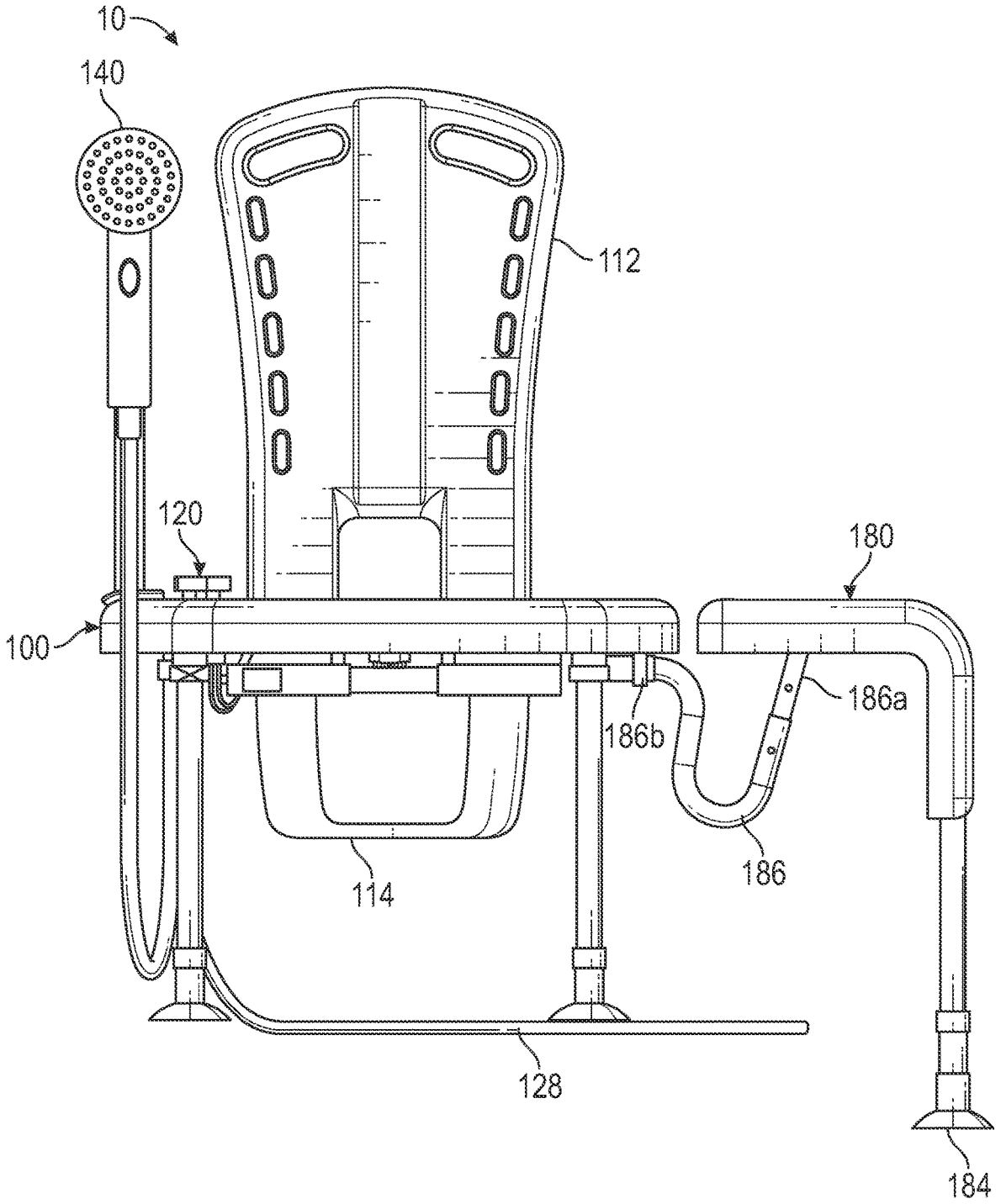
FIG. 2 is a front view of the shower chair of FIG. 1.
Figure 3:
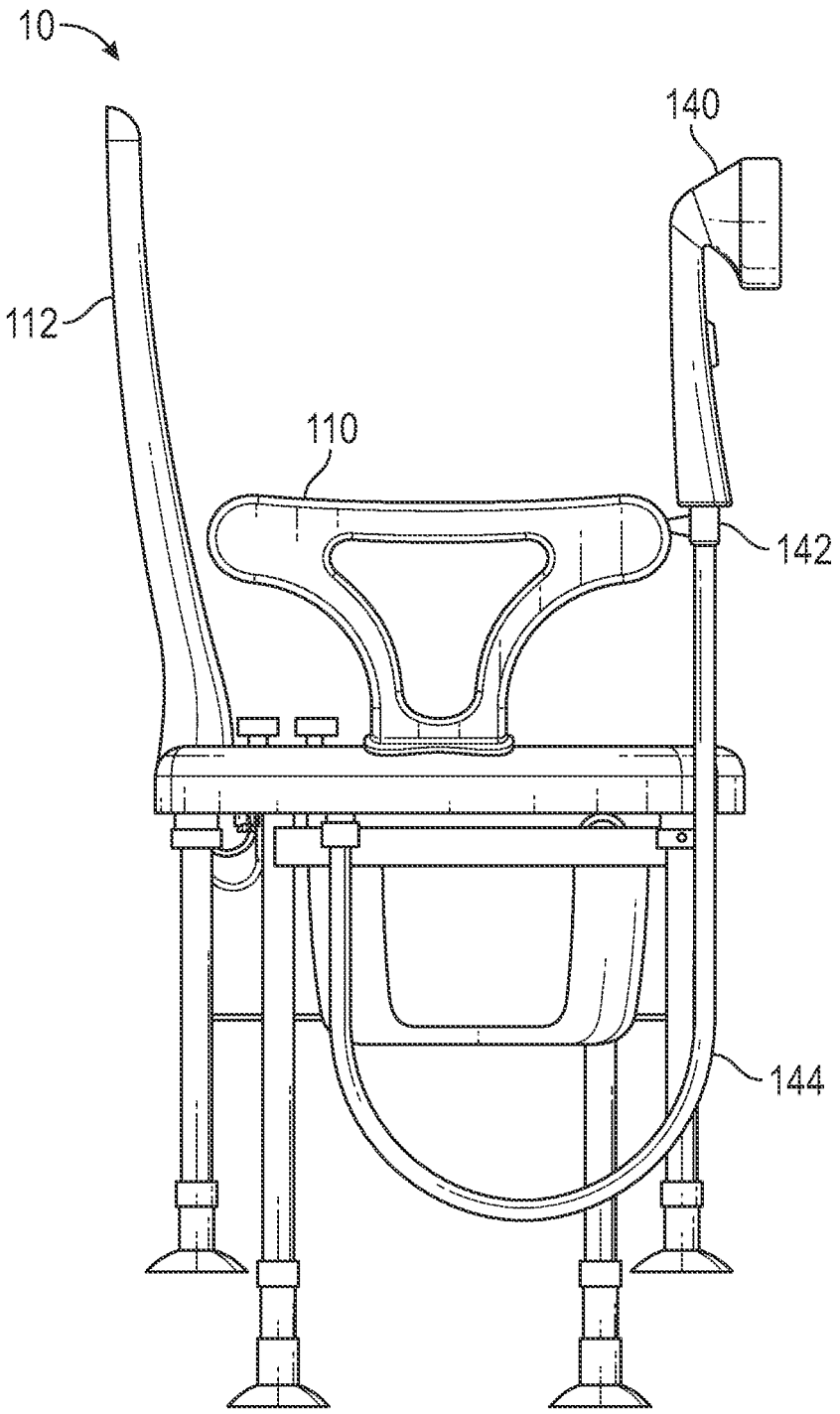
FIG. 3 is a left, side view of the shower chair of FIG. 1.
Figure 4:
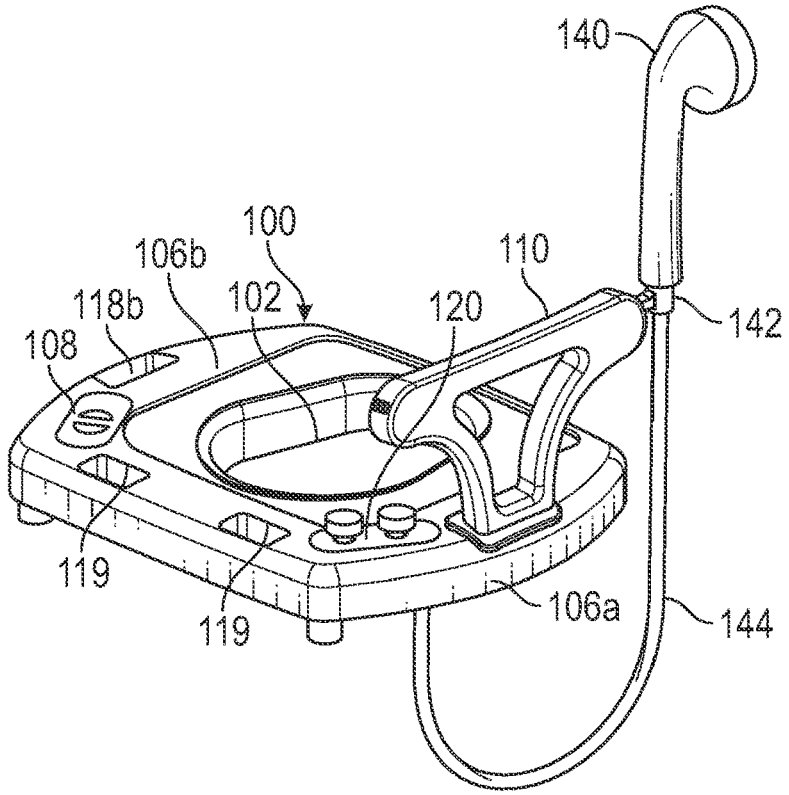
FIG. 4 is a back, perspective view of a seat board of the shower chair of FIG. 1 with a showerhead coupled to an armrest thereof.

With reference to FIGS. 4-6C, the control panel 120 includes first and second control knobs 122*a*, 122*b*, a fluid (e.g., water) inlet 124, and a fluid outlet 126*a*. In aspects, the control panel 120 includes a plurality of supplemental fluid outlets 126*b*, 126*c*, and 126*d*. The fluid inlet 124 of the control panel 120 is in fluid communication with a source of water (not shown), such as, for example, a bathtub faucet, a sink faucet, or a showerhead faucet. The control panel 120 is also in fluid communication with the showerhead 140 and the bidet assembly 160 to selectively transfer water from the source of water to the showerhead 140 and/or the bidet assembly 160. The hose 144 is coupled to the fluid outlet 126*a* and to the showerhead 140, and the control panel 120 may be coupled to the source of water via a supply hose 128 (FIG. 2).

Figure 6A:
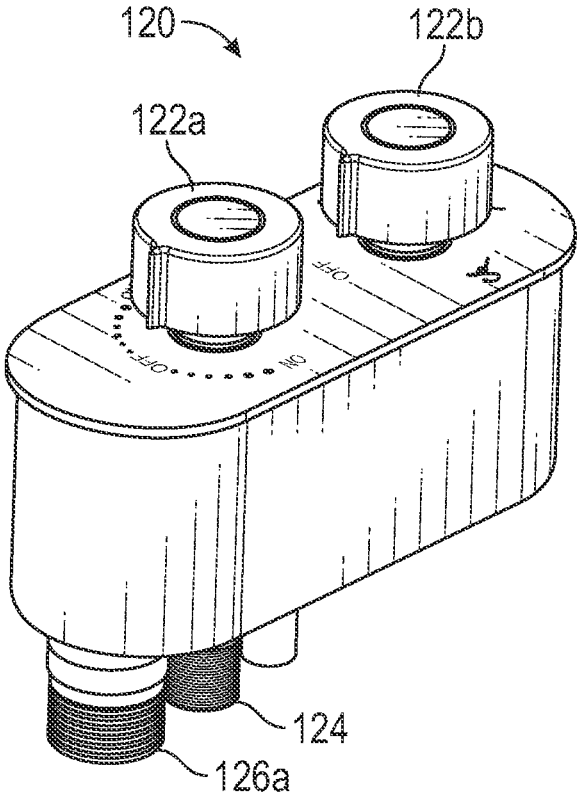
FIG. 6A is a top, perspective view of a fluid control panel of the shower chair of FIG. 1.
Figure 6B:
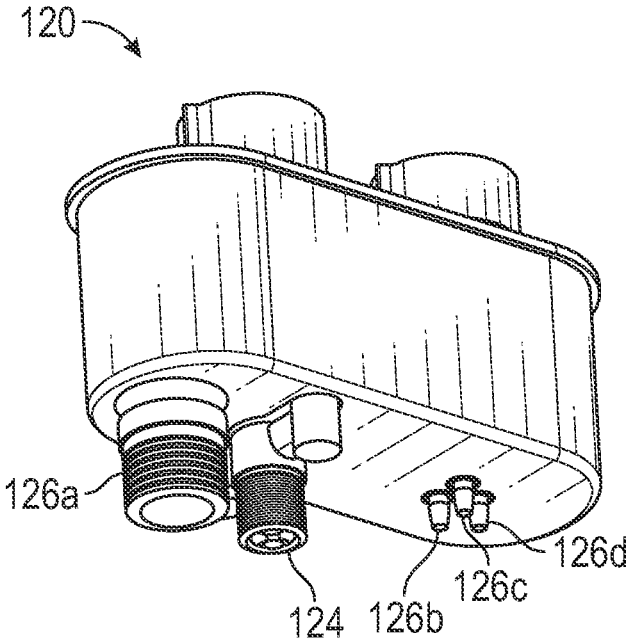
FIG. 6B is a bottom, perspective view of the fluid control panel of FIG. 6A illustrating fluid inlets and outlets.
Figure 6C:
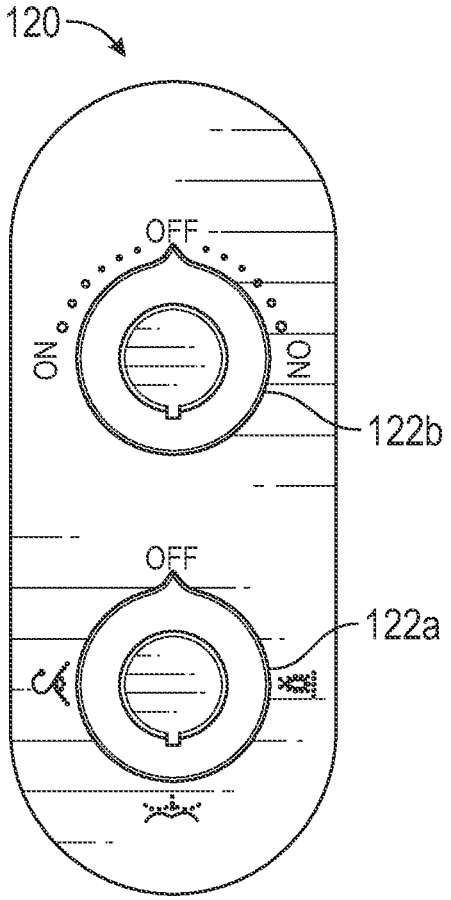
FIG. 6C is a top view of the fluid control panel of FIGS. 6A-B.

The first control knob 122*a* of the control panel 120 is in fluid communication (e.g., via a fluid connection such as a pipe, hose, or channel) with the showerhead 140 and is configured to control the operation of the showerhead 140 (e.g., control the flow of water). The second control knob 122*b* is in fluid communication with the bidet assembly 160 and is configured to control the operation of the bidet assembly 160. The first control knob 122*a* may be configured to operate bi-directionally as illustrated in FIG. 6C. For example, the control knob 122*a* may be turned to the left or the right to enable water to flow to the showerhead 140. The first and second control knobs 122*a*, 122*b* may control one or more valves (not explicitly shown) configured to regulate fluid flow out of the first, second, third, and fourth fluid outlets 126*a*, 126*b*, 126*c*, and/or 126*d*.

Figure 6D:
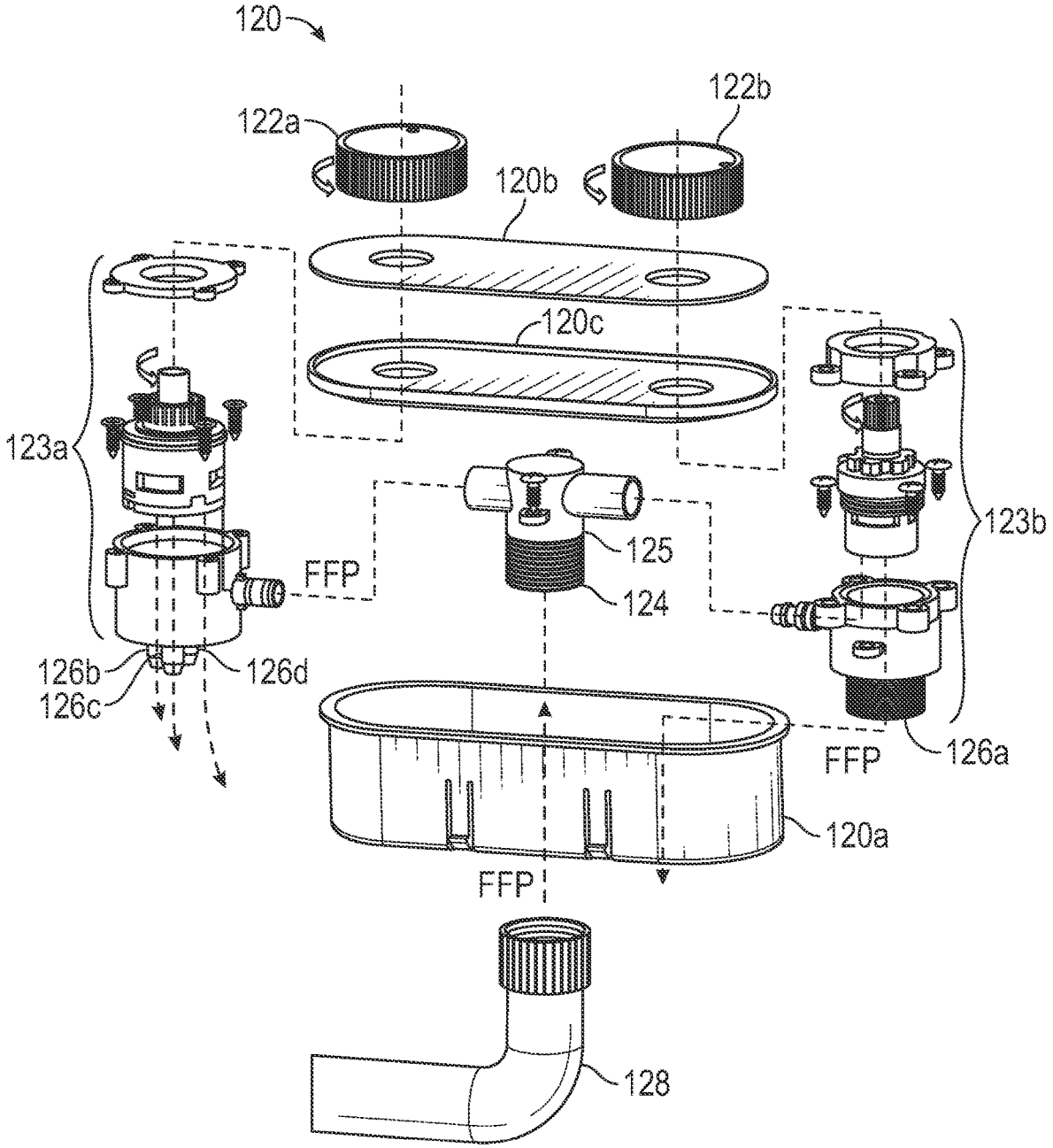
FIG. 6D is an exploded view of the fluid control panel of FIGS. 6A-C.

With additional reference to FIG. 6D, the control panel 120 includes a housing 120*a* having supported therein a first fluid distributor 123*a*, a second fluid distributor 123*b*, and a fluid diverter 125. The control panel 120 further includes a first cover 120*b* configured to cover and seal the first and second fluid distributors 123*a*, 123*b* and the fluid diverter 125 in the housing 120*a*. In aspects, a second cover 120*c* is disposed on the first cover 120*b* and forms a gasket between the first cover 120*b* and the first and second control knobs 122*a*, 122*b*.

First and second control knobs 122*a*, 122*b* are each configured to control the operation of the first and second fluid distributors 123*a*, 123*b*, respectively. First fluid distributor 123*a* is configured to selectively control the flow of fluid to and through each of fluid outlets 126*b*, 126*c*, and 126*d*. Depending on the desired bidet setting, fluid distributor 123*a* may enable fluid to flow through fluid outlets 126*b*, 126*c*, and/or 126*d*. Second fluid distributor 123*b* is configured to control the flow of fluid to and through fluid outlet 126*a*.

Fluid distributor 123*a* may be a multi-way flow valve, (e.g., a three-way flow valve or a two-way flow valve, depending on the bidet functions provided). Fluid distributor 123*b* may similarly be a multi-way valve or may be a single-way flow valve. First and second fluid distributors 123*a*, 123*b* may each be configured to pressurize the flow of fluid therethrough. A flow rate of the fluid through the fluid outlets 126*a*, 126*b*, 126*c*, 126*d*, or any combination thereof, may be controlled by respective first and second control knobs 122*a*, 122*b*.

First and second fluid distributors 123*a*, 123*b* are fluidly connected to the fluid diverter 125 that is fluidly connected to a source of water (e.g., a sink faucet or a showerhead faucet) via the inlet 124 when the supply hose 128 is connected to the inlet 124. In aspects, the fluid diverter 125 is a tee coupling, whereby fluid inlet 124 forms the vertical portion of the tee.

As indicated by the fluid flow path (FFP), fluid flows through the supply hose 128 into the fluid diverter 125. Fluid diverter 125 directs some of the fluid towards the first fluid distributor 123*a* and some of the fluid towards the second fluid distributor 123*b*.

Figure 5:
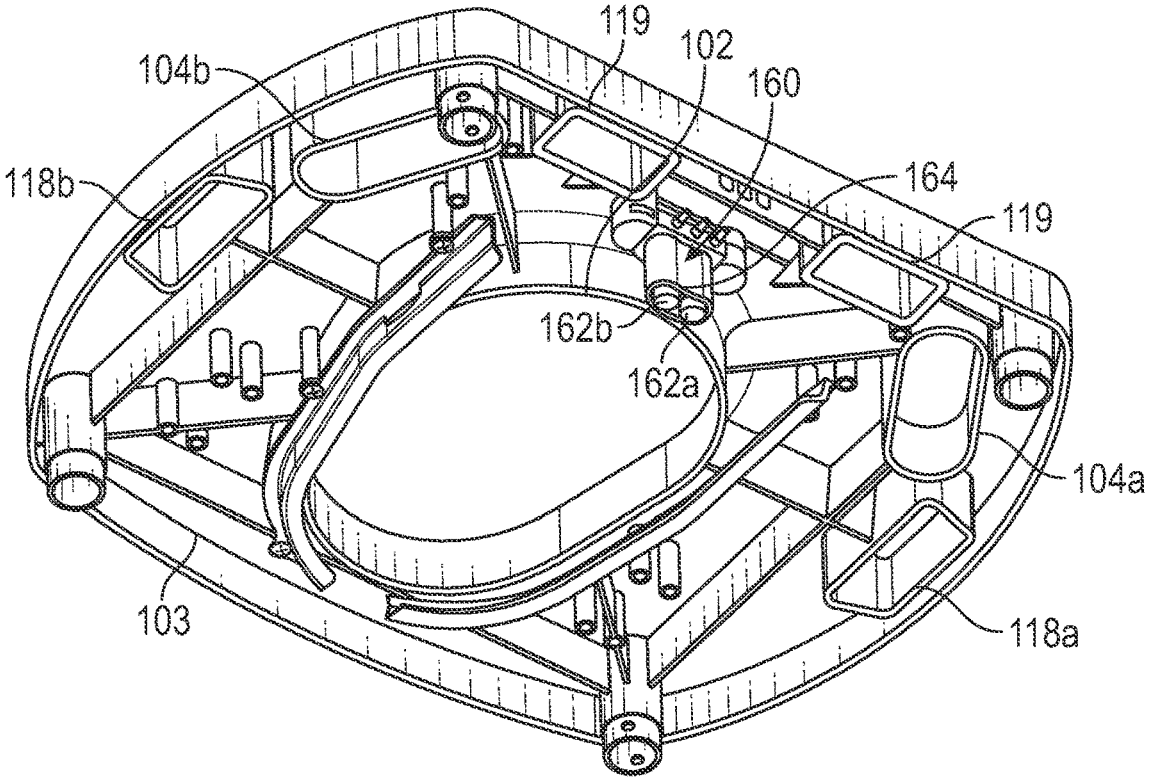
FIG. 5 is a bottom perspective view of the seat board of FIG. 4 illustrating a bidet assembly coupled thereto.
Figure 7:
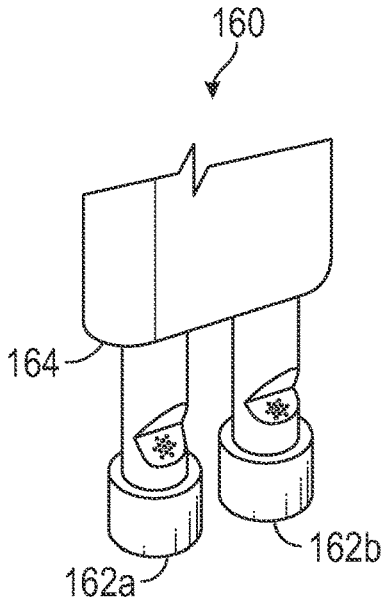
FIG. 7 is a front view of the bidet assembly of FIG. 5.
Figure 8:
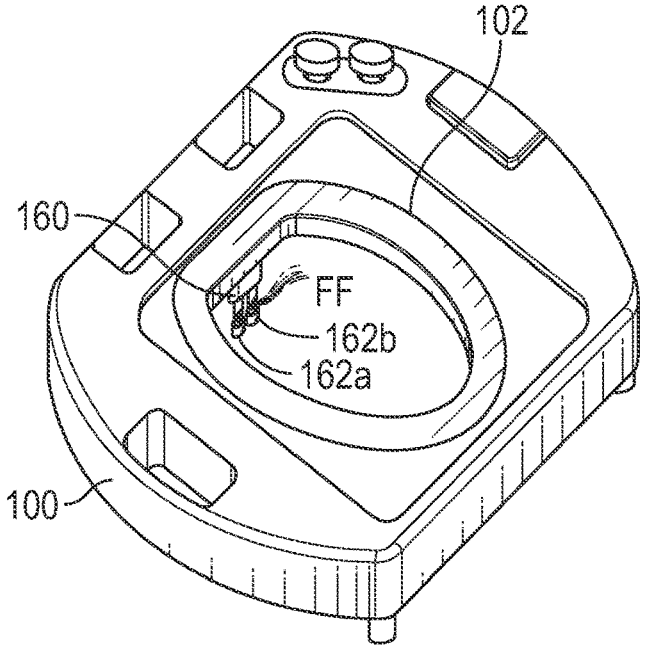
FIG. 8 is a front, perspective view of the bidet assembly of FIG. 7.

With reference to FIGS. 5, 7, and 8, the bidet assembly 160 may be coupled to the underside 103 (FIG. 5) of the seat board 100 and includes a first bidet nozzle 162*a* and a second bidet nozzle 162*b*. In aspects, the bidet assembly 160 may include a single bidet nozzle or any suitable number of bidet nozzles. The bidet assembly 160 is in fluid communication with the water source via the control panel 120 and is configured to enable a person to clean their behind and private areas. The second control knob 122*b* may be configured to control flow to the first or second bidet nozzles 162*a*, 162*b*. In aspects, the second control knob 122*b* may be turned to a first bidet nozzle on position, a second bidet nozzle on position, or a self-cleaning position. In aspects, the first bidet nozzle on position enables the first bidet nozzle 162*a* to spray water at an angle between about 45 degrees and 75 degrees such that the first bidet nozzle 162*a* cleans a person's bottom. In aspects, the second bidet nozzle on position enables the second bidet nozzle 162*b* to spray water between about 40 degrees and 60 degrees such that the second bidet nozzle 162*b* cleans a person's genital area. In aspects, first bidet nozzle 162*a* is configured to spray at about a 55 degree angle. In aspects, second bidet nozzle 162*b* is configured to spray at about a 45 degree angle. In aspects, the self-cleaning position cleans the first and second bidet nozzles. In aspects, the first and second bidet nozzles are configured to extend and retract from the bidet assembly. In aspects, when either or both of the first and second bidet nozzles retract into the bidet nozzle, the bidet nozzles are automatically cleaned. In aspects, the second control knob 122*b* is configured to control various spray types or directions (e.g., a wide spray mode, jet spray mode, front spray mode, rear spray mode) of the bidet assembly 160.

The first bidet nozzle 162*a* may be configured to spray water towards a person's behind and the second bidet nozzle 162*b* may be configured to spray water towards a person's private areas. In aspects, the first and second bidet nozzles 162*a*, 162*b* may be in a closed (e.g., no spray) position or in an extended position (e.g., spraying position). In the closed position, the first and second bidet nozzles are retracted into a housing 164 of the bidet assembly 160. For example, as shown in FIG. 7, the first bidet nozzle 162*a* is in a closed position and the second bidet nozzle 162*b* is in an extended position, and as shown in FIG. 8, both the first and second bidet nozzles 162*a*, 162*b* are in extended positions. The first and second bidet nozzles 162*a*, 162*b* are configured to spray water upwards toward or through the opening 102 of the seat board 100 as illustrated by fluid stream FF in FIG. 8. In aspects, the first and second bidet nozzles 162*a*, 162*b* may be configured to spray a stream of water through the toilet lid openings or drain holes 117 when the toilet lid 116 is received in the opening 102.

The first and second bidet nozzles 162*a*, 162*b* are in fluid communication with the control panel 120 via second, third, and fourth fluid outlets 126*b*, 126*c*, and/or 126*d*, respectively. It is contemplated that the fourth fluid outlet 126*d* may direct fluid to an internal cavity of the bidet assembly 160 during the self-cleaning mode to clean the first and second bidet nozzles 162*a*, 162*b*.

Figure 9:
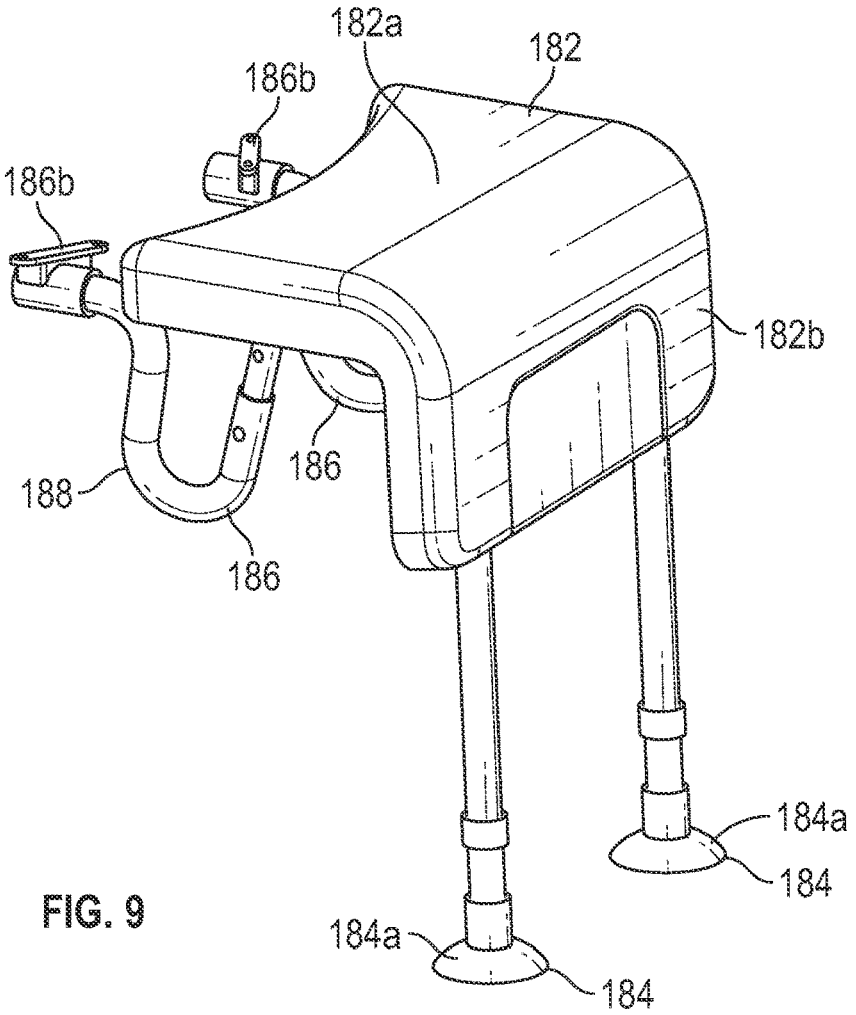
FIG. 9 is a perspective view of a transfer bench assembly of the shower chair of FIG. 1.
Figure 10:
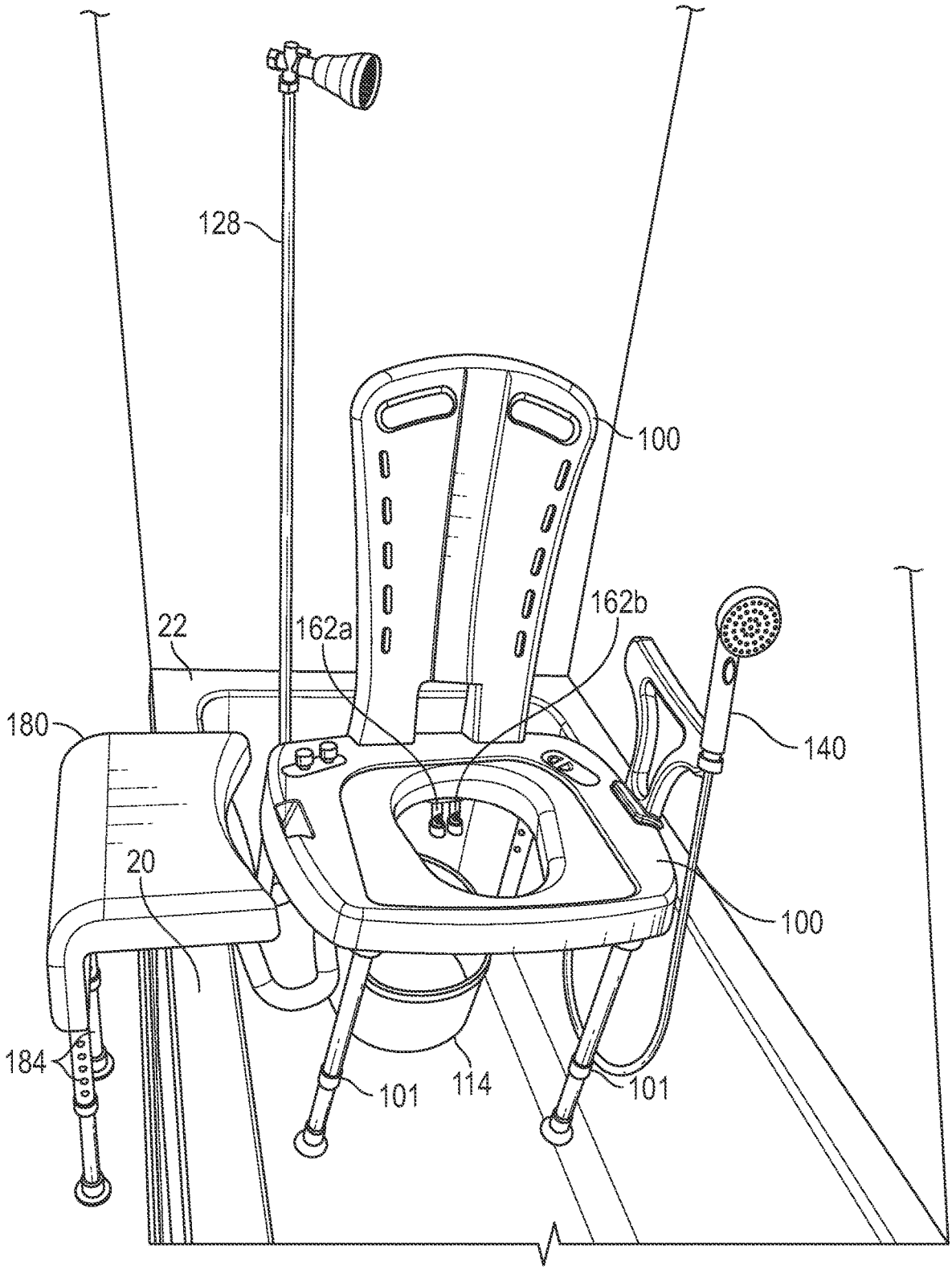
FIG. 10 is a front, perspective view illustrating the shower chair assembly of FIG. 1 positioned in a bathtub.

With reference to FIGS. 2, 9, and 10, the transfer bench assembly 180 of the shower chair 100 includes a bench seat 182 coupled to vertical supports 184 (e.g., legs). Vertical supports 184 may include suction cups 184*a* at ends of the vertical supports 184 to secure the shower chair to a floor of a bath or shower. The vertical supports 184 are configured to support the bench seat 182 at the same height as the seat board 100. The transfer bench assembly 180 is configured to couple to either the first or second lateral sides 106*a*, 106*b* of the seat board 100. In aspects, the transfer bench assembly 180 may couple to a pair of legs of the plurality of legs 101. The transfer bench assembly 180 is configured to be positioned outside a shower or bathtub and above a wall of the shower or bathtub. The transfer bench assembly 180 enables a person to sit on the bench seat 182 and slide themselves over to the seat board 100.

The bench seat 182 of the transfer bench assembly 180 may be L-shaped such that the bench seat 182 includes a first portion 182*a* in horizontal alignment with the seat board 100, and a second portion 182*b* extending perpendicularly from the first portion 182*a*. A top surface of the bench seat 182 may be approximately coplanar with a top surface of the seat board 100. The second portion 182*b* is configured to be disposed outside of a bathtub 22 or shower (FIG. 10) and abut against an outer surface of the bathtub wall 20.

The transfer bench assembly 180 further includes a pair of tubular members or shafts 186 each having a first end 186*a* connected to the bench seat 182 and a second end 186*b* (FIG. 2) configured to be connected to a respective one of the plurality of legs 101 or the underside 103 of the seat board 100. The pair of tubular members 186 each include a curved portion 188 configured to be disposed within a bathtub 22 and engaged to an inner-facing surface of a bathtub wall 20. The second portion 182*b* of the bench seat 182 and the curved portion 188 are configured to capture the wall 20 or side of the bathtub 22 therebetween. For example, as illustrated in FIG. 10, the wall 20 of the bathtub 22 may be captured and positioned between the curved portion 188 of the pair of tubular members 186 and the second portion 182*b* of the bench seat 182. In aspects, the curved portion 188 may touch or rest on the wall 20 of the bathtub 22.

With reference to FIG. 10, the shower chair 10 is shown in an exemplary configuration and positioned in a bathtub 22. The toilet bucket 114 is positioned below, but not coupled to, the seat board 100, and the toilet lid 116 is removed (not shown). The legs 101 are in a partially extended position and the vertical supports 184 of the transfer bench assembly 180 are in a fully extended position such that the seat board 100 and the bench seat 182 are approximately co-planar. The control panel 120 is positioned in the first recess 104*a* and the armrest 110 is positioned in the second aperture 118*b*.

It will be understood that various modifications may be made to the embodiments disclosed herein. Therefore, the above description should not be construed as limiting, but merely as exemplifications of various embodiments. Those skilled in the art will envision other modifications within the scope and spirit of the claims appended thereto.

What is claimed is:

1. A shower chair, comprising:

a plurality of legs;

a seat board defining an opening therethrough and configured to be supported on the plurality of legs, the seat board having a control panel with a pair of control knobs;

a showerhead configured to be in fluid communication with a first control knob of the pair of control knobs;

a bidet nozzle coupled to the seat board and configured to be in fluid communication with a second control knob of the pair of control knobs; and an armrest configured to detachably couple to the seat board, wherein the seat board has a first lateral side defining a first opening configured for removable receipt of the armrest, and a second lateral side defining a second opening configured for removable receipt of the armrest.

2. The shower chair according to claim 1, wherein the control panel is detachably coupled to the seat board.

3. The shower chair according to claim 2, wherein the seat board defines a first recess therein disposed adjacent a first lateral side of the seat board, and a second recess therein disposed adjacent a second lateral side of the seat board, the shower chair further comprising a cover plate configured to be selectively received in either of the first or second recesses, and the control panel configured to be selectively received in either of the first or second recesses.

4. The shower chair according to claim 1, further comprising a backrest configured to detachably couple to the seat board.

5. The shower chair according to claim 1, wherein the armrest has a coupling for detachably coupling the showerhead to the armrest.

6. The shower chair according to claim 1, wherein the control panel further includes a water inlet configured to fluidly connect to a source of water, a first outlet configured to fluidly connect to the showerhead, and a second outlet configured to fluidly connect to the bidet nozzle.

7. The shower chair according to claim 1, further comprising a transfer bench assembly configured to detachably couple to the seat board.

8. The shower chair according to claim 7, wherein the transfer bench assembly includes:

a bench seat; and a pair of vertical supports configured to support the bench seat.

9. The shower chair according to claim 8, wherein the bench seat has a first portion configured to be in horizontal alignment with the seat board, and a second portion extending perpendicularly from the first portion and configured to be disposed outside of a bathtub.

10. The shower chair according to claim 9, wherein the transfer bench assembly further includes a pair of tubular members each having a first end connected to the bench seat, and a second end configured to be connected to a respective one of the plurality of legs.

11. The shower chair according to claim 10, wherein each of the pair of tubular members has a curved portion configured to be disposed within a bathtub, the second portion of the bench seat and the curved portion being configured to capture a side of the bathtub therebetween.

12. The shower chair according to claim 1, further comprising a toilet bucket configured for detachable connection to an underside of the seat board and defining a cavity in overlapping alignment with the opening of the seat board.

13. A modular shower chair, comprising:

a plurality of legs;

a seat board defining an opening therethrough and configured to be supported on the plurality of legs, the seat board having opposing first and second lateral sides;

a bidet nozzle coupled to the seat board and configured to spray water through the opening;

an armrest configured to detachably couple to either of the first or second lateral sides of the seat board; and a transfer bench assembly configured to detachably couple to the seat board.

14. The modular shower chair according to claim 13, further comprising a control panel with a pair of control knobs, a first control knob of the pair of control knobs configured to be in fluid communication with a showerhead, and a second control knob of the pair of control knobs configured to be in fluid communication with the bidet nozzle.

15. The modular shower chair according to claim 14, wherein the seat board defines a first recess therein disposed adjacent the first lateral side of the seat board, and a second recess therein disposed adjacent the second lateral side of the seat board, the control panel being configured to be selectively received in either of the first or second recesses.

16. The modular shower chair according to claim 15, further comprising a cover plate configured to be selectively received in either of the first or second recesses.

17. The modular shower chair according to claim 13, wherein the transfer bench assembly includes:

an L-shaped bench seat having a horizontal portion and a vertical portion;

a pair of vertical supports configured to support the bench seat; and a pair of tubular members each having a first end connected to the bench seat, and a second end configured to be coupled to the seat board.

18. The modular shower chair according to claim 17, wherein each of the pair of tubular members has a curved portion configured to be disposed within a bathtub, the vertical portion of the bench seat and the curved portion configured to capture a side of the bathtub therebetween.

19. A shower chair, comprising:

a plurality of legs;

a seat board defining an opening therethrough and configured to be supported on the plurality of legs, the seat board having a control panel with a pair of control knobs, the control panel being detachably coupled to the seat board, the seat board defining a first recess therein disposed adjacent a first lateral side of the seat board, and a second recess therein disposed adjacent a second lateral side of the seat board;

a showerhead configured to be in fluid communication with a first control knob of the pair of control knobs;

a bidet nozzle coupled to the seat board and configured to be in fluid communication with a second control knob of the pair of control knobs; and a cover plate configured to be selectively received in either of the first or second recesses, wherein the control panel is configured to be selectively received in either of the first or second recesses.

20. A shower chair, comprising:

a plurality of legs;

a seat board defining an opening therethrough and configured to be supported on the plurality of legs;

a control panel including a pair of control knobs;

a showerhead configured to be in fluid communication with a first control knob of the pair of control knobs; and a bidet nozzle coupled to the seat board and configured to be in fluid communication with a second control knob of the pair of control knobs, wherein the control panel further includes a water inlet configured to fluidly connect to a source of water, a first outlet configured to fluidly connect to the showerhead, and a second outlet configured to fluidly connect to the bidet nozzle.

21. A shower chair, comprising:

a plurality of legs;

a seat board defining an opening therethrough and configured to be supported on the plurality of legs;

a showerhead configured to be in fluid communication with a first control knob;

a bidet nozzle coupled to the seat board and configured to be in fluid communication with a second control knob; and a transfer bench assembly configured to detachably couple to the seat board.

22. The shower chair according to claim 21, wherein the transfer bench assembly includes:

a bench seat; and a pair of vertical supports configured to support the bench seat.

23. The shower chair according to claim 22, wherein the bench seat has a first portion configured to be in horizontal alignment with the seat board, and a second portion extending perpendicularly from the first portion and configured to be disposed outside of a bathtub.

24. The shower chair according to claim 23, wherein the transfer bench assembly further includes a pair of tubular members each having a first end connected to the bench seat, and a second end configured to be connected to a respective one of the plurality of legs.

25. The shower chair according to claim 24, wherein each of the pair of tubular members has a curved portion configured to be disposed within a bathtub, the second portion of the bench seat and the curved portion being configured to capture a side of the bathtub therebetween.

26. A shower chair, comprising:

a plurality of legs;

a seat board defining an opening therethrough and configured to be supported on the plurality of legs;

a showerhead configured to be in fluid communication with a first control knob;

a bidet nozzle coupled to the seat board and configured to be in fluid communication with a second control knob; and a toilet bucket configured for detachable connection to an underside of the seat board and defining a cavity in overlapping alignment with the opening of the seat board.

* * * * *